US007105465B2

(12) United States Patent
Patel et al.

(10) Patent No.: US 7,105,465 B2
(45) Date of Patent: Sep. 12, 2006

(54) PAPERMAKING BELTS AND INDUSTRIAL TEXTILES WITH ENHANCED SURFACE PROPERTIES

(75) Inventors: Sanjay Patel, Summerville, SC (US); Michael David Draper, Lancashire (GB)

(73) Assignee: Voith Fabrics Heidenheim GmbH, Heidenheim (DE)

( * ) Notice: Subject to any disclaimer, the term of this patent is extended or adjusted under 35 U.S.C. 154(b) by 0 days.

(21) Appl. No.: 10/887,661

(22) Filed: Jul. 9, 2004

(65) Prior Publication Data

US 2005/0124243 A1 Jun. 9, 2005

Related U.S. Application Data

(63) Continuation of application No. PCT/GB03/00076, filed on Jan. 10, 2003.

(30) Foreign Application Priority Data

Jan. 10, 2002 (GB) ..... 0200462.0
Aug. 9, 2002 (GB) ..... 0218536.1

(51) Int. Cl.
*B32B 5/02* (2006.01)
*B32B 27/04* (2006.01)
*B32B 27/12* (2006.01)

(52) U.S. Cl. ..... 442/88; 442/86; 442/93; 442/94; 442/97; 442/98; 162/199

(58) Field of Classification Search ..... 162/199; 34/116, 123; 442/149; 139/383 A, 383 AA, 139/383 B; 524/376, 379, 502, 504, 574, 524/540

See application file for complete search history.

(56) References Cited

U.S. PATENT DOCUMENTS

| | | | | |
|---|---|---|---|---|
| 3,238,087 | A | 3/1966 | Norwalk et al. | 161/185 |
| 4,345,730 | A | 8/1982 | Leuvelink | 245/6 |
| 4,355,122 | A * | 10/1982 | Fan | 523/423 |
| 4,374,875 | A | 2/1983 | Fan | 427/386 |
| 4,559,247 | A | 12/1985 | Kopf et al. | 427/386 |
| 4,954,553 | A * | 9/1990 | Johnson et al. | 524/376 |
| 5,019,428 | A | 5/1991 | Lüdemann et al. | 427/387 |
| 5,384,365 | A * | 1/1995 | Hanada et al. | 525/105 |
| 5,395,868 | A | 3/1995 | Sanduja et al. | 524/104 |
| 5,574,079 | A | 11/1996 | Eaton et al. | 523/423 |
| 6,017,417 | A | 1/2000 | Wendt et al. | 162/109 |
| 6,034,160 | A | 3/2000 | Eaton et al. | 524/376 |
| 6,284,380 | B1 | 9/2001 | Martin et al. | 428/422 |
| 6,331,230 | B1 | 12/2001 | Hermans et al. | 162/207 |
| 2002/0009937 | A1 * | 1/2002 | Dukes et al. | 442/156 |

FOREIGN PATENT DOCUMENTS

WO 01/44568 6/2001

OTHER PUBLICATIONS

S.H. Zeronian, et al. "Textile Progress", 1989.

* cited by examiner

*Primary Examiner*—Norca Torres
*Assistant Examiner*—Matthew D. Matzek
(74) *Attorney, Agent, or Firm*—Taylor & Aust, P.C.

(57) ABSTRACT

An industrial textile including a polymeric substrate and a resin system grafted onto the polymeric substrate by way of a primer. The resin system includes a water-borne thermoplastic, a polyhydroxyether resin and/or an analogue of a polyhydroxyether resin, and at least one co-resin.

34 Claims, No Drawings

PAPERMAKING BELTS AND INDUSTRIAL TEXTILES WITH ENHANCED SURFACE PROPERTIES

CROSS REFERENCE TO RELATED APPLICATIONS

This is a continuation of PCT Application No. PCT/GB03/00076, entitled "PAPERMAKING BELTS AND INDUSTRIAL TEXTILES WITH ENHANCED SURFACE PROPERTIES", filed Jan. 10, 2003.

BACKGROUND OF THE INVENTION

1. Field of the Invention

The present invention relates to industrial fabrics and has particular relevance to fabrics on which non-woven materials may be formed by hydroentanglement and other formation techniques for the "Nonwovens" market sector and to papermakers' fabrics, such as forming fabrics, dryer fabrics and fabrics for use in the production of paper products using through-air drying (TAD) installations.

2. Description of the Related Art

TAD fabrics are conventionally used in the manufacture of paper towels, facial tissue, bathroom tissue, table napkins and the like.

U.S. Pat. Nos. 6,017,417 and 6,331,230; and Publication WO 01/44568 describe the manufacture of tissue and the like using through-air drying. Typically, in such processes, a slurry of cellulosic fibers is fed onto a forming fabric or between two forming fabrics, where the paper web is formed and partially dewatered before the web is transferred, often via a transfer fabric, to a TAD fabric for further water removal by way of one or multiple TAD units. The web is then fed by way of the TAD fabric to a presser roll where a nip is formed between the TAD fabric and a Yankee cylinder. Here the paper web transfers to the Yankee cylinder where further drying and creping takes place. In one variation of this process, the Yankee cylinder is removed, thus eliminating the pressing nip. In this case, the web is transferred from the TAD fabric to a further fabric.

It is conventional to spray a chemical release agent, e.g. silicone oil onto the TAD fabrics in order to provide good sheet release, whether it be to aid the transfer of the sheet on to another fabric or on to the Yankee cylinder, after exiting the presser roll nip. There are a number of potential problems associated with using a chemical release agent in the TAD process, two of these being that they are messy to utilize and very expensive.

TAD fabrics are flat-woven fabrics, which are spliced together. Adhesive is applied to the terminal ends in the joint area to provide supplementary strength and to keep these terminal ends in-plane. It has been found that when no adhesive is present, the chemical release agent tends to facilitate the process of allowing the terminal ends to relax under operating temperatures, which causes them to come out of plane of the fabric. Once out of plane, damage to, or rupture of, the sheet will inevitably occur and the seam will slowly fatigue until premature failure occurs. The use of adhesive in the joint area helps keep the terminal ends in place but adversely affects the porosity of the fabric at the joint, which can in turn have an unfavorable impact on the product quality and machine performance.

What is needed in the art is a seam that has the property of terminal end restraint without utilizing an adhesive.

Furthermore, chemical release agents have been found to accumulate on the fabric causing waste fiber to build-up and block the surface. This also affects the rate of drying and thus paper quality.

Probably the most critical problem, with the use of the chemical release agent, is the fact that it remains in the recycled white water system. Most modern paper machines tend to have closed water systems, and so the water that is removed from the cellulosic stock during the papermaking process and the reclaimed fabric shower water is collected, recycled and then reused as shower water and also to dilute the new cellulsoic stock. In the interim period, the water is stored in holding tanks and here the minute beads of chemical release agent coalesce into larger globules. It is extremely difficult to separate the chemical release agent from the water and the globules end up coating these tanks, which finally make their way back into the system. When the globules find their way into the cellulosic stock, there are potentially a number of problems, all of which result in a reduction of paper quality and machine operating efficiency.

The paper stock is a complex, charged system, with additives, such as cationic retention aids, added in order to ensure that all of the individual components of the stock bond together. When oil gets into this system it interferes with these charges and suppresses the effectiveness of the additives. This in turn leads to higher operating costs since additional amounts of additives are needed to achieve the desired sheet properties.

Another problem is that globules in the stock act as a debonder and reduce the sheet strength. Machine refining must be increased to compensate for the loss in sheet strength, which makes the sheet harder to dewater and/or dry and, in some cases, results in a loss of machine speed and/or output.

During manufacture the sheet side of conventional TAD fabrics is sanded, so as to increase the surface contact area of the fabric from between 6–12% to between 20–30%. This is required in order to ensure good transfer of the paper web, for example, from the TAD fabric to the Yankee cylinder and it also ensures good final sheet strength. The sanding process usually encourages the onset of micro-fibrillation of the yarn components on the paper-facing side, a problem that is accentuated through the use of high pressure showers. These fibrils eventually cause a reduction in the fabric's permeability which in turn leads to a poor drying profile and subsequently to a lower machine output.

TAD fabrics are conventionally made from polyester yarns, designed to improve their dry heat, hydrolysis and abrasion resistant properties. The operating environment on a TAD machine accelerates polymer degradation due to these phenomena, which ultimately causes fabric failure to occur. Fabric cleanliness is also an issue with conventional dryer and TAD fabrics in that dirt or so-called "stickies" tend to adhere to the fabric surface, which can cause holes in the sheet. Conventional TAD fabrics may also suffer from a lack of rigidity leading to cross-machine direction undulations in the fabric, particularly post the TAD cylinders. Occasionally, the undulations can be so severe as to cause irreversible localized folding of the fabric, necessitating its removal from the machine.

What is needed in the art is a fabric that reduces or eliminates the foregoing related problems.

SUMMARY OF THE INVENTION

According to one aspect of the present invention there is provided an industrial textile including a polymeric substrate and a resin system grafted onto the polymeric substrate, by way of a primer, wherein the resin system includes water-borne thermoplastic, optionally fluorinated, polyhydroxyether resin and/or one or more analogues thereof and at least one co-resin.

The term "grafting" as used herein is used to refer to the attachment of a chemical unit to a main molecular chain.

The primer facilitates good adhesion between the resin system and the polymeric substrate.

The industrial textile of the invention may include a woven and/or nonwoven fabric.

DETAILED DESCRIPTION OF THE INVENTION

In one embodiment of the present invention there is provided a TAD fabric including a polymeric substrate and a resin system grafted onto the polymeric substrate, by way of a primer, wherein the resin system includes water-borne thermoplastic, fluorinated, polyhydroxyether resin and/or one or more analogues thereof and at least one co-resin.

A fluorinated polyhydroxyether resin is preferred in TAD applications, which provides excellent sheet release.

Examples of analogues of polyhydroxyether resins include polyurethane modified polyhydroxyether resin, epoxy end-capped polyhydroxyether resin and polycaprolactone modified polyhydroxyether resin.

The polymeric substrate used in the invention ideally includes PET (polyester), PPS (polyphenylene sulphide), PCTA (poly1,4cyclohexalene dimethylene terephthalate), PEN (polyethylene naphthalate) or PEEK (polyetheretherketone). The substrate can also be of hybrid construction, where, for example, one of the warp yarns or weft yarns are made of PET and the other of the warp yarns or weft yarns are made of PVDF (polyvinylidene fluoride).

The water-borne surface enhancement composition of the invention does not cause environmental problems as compared with the prior art epoxy resin coating compositions.

The permanent chemical modification of the conventional polyester, modified polyester, PPS, PEEK or any suitable polymeric substrate for the manufacture of TAD fabrics, in accordance with the present invention, provides a number of benefits including the enhancement of hydrophobic properties giving permanent superior paper web sheet release. This eliminates, or at least minimizes then need to continuously apply a temporary chemical release agent to the TAD fabric. A further benefit of the inherent film bonding strength of the resin composition, is the eradication of the need for the adhesive, currently applied to the terminal ends, in the seam area.

The TAD fabrics of the invention also exhibits reduced fibrillation in that the treatment of the fabric, post the surface grinding stage, envelopes, captures and locks back into the surface any protruding fibrils so as to reduce the risk of these being the source of cellulosic fiber build-up, as well as of large scale fibrillation. In addition, the treatment smooths out the micro rough area, created during grinding, by filling in the valleys between the fibrils.

The added, chemically grafted, layer also reduces the rate of thermal degradation by forming a permanent, heat resistant barrier. Also, due to the oleophobic nature of the surface enhancement, because of the addition of fluorine, the fabric tends to stay cleaner. In addition, improved x/y fabric rigidity, through binding of the cross-over points, result in less tendency towards undesirable cross-machine corrugation.

It is also believed that the hydrophobic surface modifications have the effect of reducing the capillary action, particularly at the machine direction (md) and cross machine direction (cmd) over points, that retain the water in the fabric post showering. This means that devices, such as a vacuum box and/or air knife, used to remove residual water, are able to work far more effectively. The result is a lower amount of residual fabric water post cleaning, a lower drying load on the TADs and more efficient drying, hence lower overall energy consumption. The water-borne thermoplastic polyhydroxyether grafted layer, with co-resins and modifiers, also has a more universal application in the manufacture of other papermaker fabrics, such as forming fabrics, press felts, tissue fabrics and dryer fabrics.

Papermachine clothing is essentially employed to carry the paper web through the various stages of the papermaking machine. In the forming section, the fibrous furnish is wet-laid onto a moving forming wire and water is allowed to drain from it. The paper web is then transferred to a press fabric that conveys it through the pressing section, where it is usually passes through a series of nips formed by rotating cylindrical press rolls. Water is squeezed from the paper web and into the press fabric, as the web and fabric pass through the nip together. In the final stage, the paper web is transferred either to a Yankee dryer, in the case of tissue paper manufacture, or to a dryer fabric, the majority of the remaining water being evaporated as the paper passes around a number of steam heated dryer cylinders.

Many known forming fabrics, press fabrics, like TAD fabrics, suffer from adherence by stickies, poor wear resistance, poor fabric stability and/or stiffness. There are a number of patents which have attempted to address, in particular, the problem of contamination.

U.S. Pat. No. 5,019,428 describes the application of modified polyurethanes containing perfluoroaliphatic groups to fiber-materials to provide oil-and-water-repellent finishes.

U.S. Pat. Nos. 5,395,868 and 5,207,873 disclose a coating solution for papermaking fabrics that includes, as its primary components, polytetrafluoroethylene, urethane copolymer and polyacrylamide. U.S. Pat. No. 6,284,380 discloses papermaker fabrics having a polyurethane based coating including a copolymer of perfluoroalkyl acrylates. These coatings are claimed to render these papermaker fabrics contamination resistant. It is noted however that in none of the prior art is there an indication that there is a priming process involved, even though it is well known that the adhesion of coatings to polyester and some other polymers is difficult, due to the lack of bonding sites on the polymer's surface. ("Surface modifications fo PET by Alkali Treatment", Textile Progress, Vol. 20, No. 2, 1989 By S. H. Veronian and Textile Research Journal 1978, Vol. 48, No. 4, by A. D. Weigmann). In addition, being non-waterborne additives, the prior art coatings are likely to be less environmentally friendly than water-borne chemicals, because of the possibility of the generation of undesirable volatile organic compounds. One further drawback of the prior art coatings containing polytetrafluoroethylene is that it may be necessary to deploy high curing temperatures, which may be disadvantageously close to the heat setting and melting temperatures of the polymeric substrate.

In another embodiment of the present invention there is provided a papermaker fabric including a polymeric substrate and a resin system grafted onto the polymeric substrate by way of a primer, wherein the resin system includes water-borne thermoplastic, optionally fluorinated, polyhydroxyether resin and/or one or more analogues thereof and at least one co-resin.

For the avoidance of doubt, the papermaker fabric as hereinbefore described has, as one of its many potential applications, an application as a non-TAD tissue-making fabric.

The papermaker fabrics of the invention have a preferred application as a forming fabric. Here the added, chemically modified, surface of the invention results in virtually no overall loss in cfm, but gives a reduction in the adherence of stickies, which saves the user wash-up time, as well as reducing the need for continuous high pressure cleaning showers and chemical treatments. It also results in an increase in the fabric stability, due to bonding at the cross-over points and a reduction in the apparent carrying of water because of the filled cross-over points.

The papermaker fabrics of the invention have further application as a dryer fabric. Here the preferred polymeric substrate includes any of PET, PPS, PCTA, PEN or PEEK.

The chemically modified substrate of the invention results in a reduction in the adhesion of stickies, the stiffening of the fabric and the protection of the dryer fabric yarns by insulating them from the heat and also preventing the ingress of water into the yarn cross-over locations, with virtually no loss of cfm.

The chemically modified substrate of the invention has particular application when the polymeric substrate includes PET, PPS, PCTA, PEN or PEEK. Other possible polymeric substrates could be one or more thermoplastic elastomers such as PU (polyurethane).

In a further embodiment of the present invention there is provided an industrial fabric including a polymeric substrate and a resin system grafted onto the polymeric substrate, by way of a primer, wherein the resin system includes water-borne thermoplastic, optionally fluorinated, polyhydroxyether resin and/or one or more analogues thereof and at least one co-resin.

The present invention also has application in the manufacture of non-woven materials for the nonwovens sector. Nonwovens can either be dry or wet formed. To add strength, the sheet is hydroentangled or a bonding agent is applied to the web and then cured.

In a further embodiment of the present invention, there is provided a hydroentanglement screen on which nonwoven materials are formed by hydroentanglement. The screen includes a polymeric substrate and a resin system grafted onto the polymeric substrate, by way of a primer, wherein the resin system includes water borne thermoplastic, optionally fluorinated, polyhydroxyether resin and/or one or more analogues thereof and at least one co-resin.

The chemically modified substrate of the invention displays increased wear resistance, superior sheet release, a reduction in water carriage back into the hydroentanglement zone and a reduction in the incipient carrying of water because of the filled cross-over points.

In a further embodiment of the present invention, there is provided a conveying fabric on which latex impregnation of conventionally air-laid materials occurs, the conveying fabric includes a polymeric substrate and a resin system grafted onto the polymeric substrate by way of a primer, wherein the resin system includes water-borne thermoplastic, optionally fluorinated, polyhydroxyether resin and/or one or more analogues thereof and at least one co-resin.

The use of a latex binder is an extremely messy process and results conventionally in the need for unscheduled machine shut-downs in order to clean the contaminated substrate. The chemical surface modifications of the invention reduces or eliminates the need for these shut downs and extends the life of the fabric beyond current levels. Contamination of the conveying fabric can also arise from the presence of dry binders, such as low melt fibers. The chemically modified surface renders easy removal of such contamination.

The various fabric screens used for the manufacture of nonwoven products described herein may be woven or nonwoven. In one embodiment of the present invention the screens include a non-woven, spiral link fabric, as descried in U.S. Pat. No. 4,345,730.

In a further embodiment of the present invention there is provided a screen on which a spun bonding process occurs, the screen includes a polymeric substrate and a resin system grafted onto the polymeric substrate by way of intermediate primer, wherein the resin system includes water-borne thermoplastic, optionally fluorinated, polyhydroxyether resin and/or one or more analogues thereof and at least one co-resin.

In a further embodiment of the present invention there is provided a screen on which a melt blowing process occurs, the screen includes a polymeric substrate and a resin system grafted onto the polymeric substrate by way of intermediate primer, wherein the resin system includes water-borne thermoplastic, optionally fluorinated, polyhydroxyether resin and/or one or more analogues thereof and at least one co-resin.

Papermachine fabrics tend to be manufactured from synthetic materials, such as polyester, which are commonly used for TAD fabrics, forming fabrics and dryer fabrics. This, and any other suitable substrates onto which the resins are capable of being grafted, can be used. As alluded to earlier, it has been known that permanent adhesion of materials to polyester is notably difficult to achieve because of a lack of surface reactive sites on the polymer's outer surfaces, and the inability of any modifying medium to penetrate the substrate to any useful degree. It is a feature of the invention to pre-activate the surface of the substrate by way of a priming step. This involves the use of a physical priming method, such as a Plasma or Corona treatment. However, a chemical primer step is preferred. Such primers will be described in more detail hereinafter. Once primed, a second resin mixture is grafted to the polyester through this primer. The second resin mixture layer is designed to impart specific properties to the fabric. In the present invention, the main component of the second layer is a "water-borne thermoplastic polyhydroxyether resin" and/or analogues thereof, ideally together with one or more other co-resins.

In a further embodiment of the present invention there is provided an industrial fabric including a polymeric substrate, wherein a primer is secured to the polymeric substrate and wherein a resin system including water-borne thermoplastic, optionally fluorinated, polyhydroxyether resin and/or one or more analogues thereof and at least one co-resin is grafted onto the substrate by way of a primer, and wherein the polymeric substrate includes any of PET, PEN, PPS, PCTA or PEEK.

Ideally the water-borne thermoplastic polyhydroxyether resin is fluorinated.

The resin mixture includes the aforesaid polyhydroxyether and/or one or more analogues thereof and one or more co-resins, ideally including polyurethane and/or a polyurethane derivative. The resin mixture may also further include one or more siloxanes, preferably an amine functional siloxane. These resins are cross-linked so as to form an interpenetrating polymeric network.

In a further embodiment of the invention there is provided a method of making tissue paper including the use of a TAD fabric. In the process no chemical release agent is applied to the TAD fabric. Further, there is a water-borne thermoplastic, optionally fluorinated, polyhydroxyether resin and/or one or more analogues thereof and at least one co-resin grafted onto a least a part of the polymeric substrate, by way of an intermediate primer.

The term "water-borne thermoplastic polyhydroxyether resin", as used herein, refers to a polyhydroxyether (e.g. a phenoxy) resin to which is grafted one or more ethylenically unsaturated monomers. It is desirable that at least one of the monomers contains carboxyl groups. These polyhydroxyethers are ideally prepared as water-borne amine neutralized, carboxylated, polyhydroxyether resin coating compositions such as the type described in U.S. Pat. Nos. 6,034,160 and 5,574,079. Such a coating composition does not cause environmental problems as compared with the prior art epoxy resin coating compositions, which generally include organic solvents. The coating compositions of U.S. Pat. Nos. 6,034,160 and 5,574,079 as well as U.S. Pat. Nos. 4,374,875; 4,559,247; and 4,355,122; have previously been used in the coating of metals, but not textile materials. These documents describe a coating composition in the form of an aqueous dispersion of a water-miscible base and amorphous thermoplastic polyhydroxyether. The thermoplastic polyhydroxyether has a polydispersity of less than 4.0 and a number average molecular weight of between 7,000 and 12,000 and has grafted thereon one or more ethylenically unsaturated monomers. Polydispersity is the ratio of weight average molecular weight to the number average molecular weight of a particular thermoplastic polyhydroxyether resin. The polyhydroxyethers preferably have a weight average molecular weight greater than about 20,000 and less than about 45,000. This is much higher than epoxy resins, which have a maximum molecular weight of about 8,000, which by comparison means that phenoxy has far greater toughness and a higher Tg. In addition, the major advantage of polyhydroxyether resins over epoxy resins is that they have primary and secondary hydroxyl groups for reactivity and cross-linking. The ethylenically unsaturated monomers preferably have from about 3 to 8 carbons and are selected from the group consisting of methyl methacrylate, ethyl acrylate, n-propyl methacrylate, butyl acrylate, acrylonitrile, methyacrylonitrile, styrene, alpha-methyl styrene and p-vinyl toluene.

At least one of the ethylenically unsaturated monomers preferably contains sufficient carboxyl groups to provide from about 1 to 100 carboxyl groups per 10 monomeric units of thermoplastic polyhydroxyether. This monomer is preferably selected from the group consisting of acrylic acid, methacrylic acid, itaconic acid, maleic acid and fumaric acid. The polyhydroxyether resins are ideally fluorinated.

A preferred resin is PKHW-34F, which has a long fluorinated carbon chain, which is supplied by Phenoxy Associates. It is common knowledge that for fluorocarbon repellents on a fabric, approximately 10 fully fluorinated carbon atoms are needed in a normal alkane chain to achieve maximum repellency (Fluorinated Surfactants and Repellents, Second Edition, Erik Kissa, page 531).

The fluorinated resin, along with co-resins and cross-linking agents, act to lower the surface energy of the fabric to less than about 20 dynes/cm, thereby improving paper sheet releasability due to the increased hydrophobicity. This hydrophobicity has been achieved through the synergistic action of the fluorine and silicone groups in the resin mixture. The oil and dirt repellency is solely attributable to the fluorine atoms present.

Additionally, an alternative fluorinated polymer, ideally having hydroxyl groups, may be added to the formulation. An example of such a material is LUMIFLON 4400 SERIES made by Asahi Glass and sold by AGA Chemicals. LUMIFLON is a non-ionic water emulsion of a ter-polymer made of a vinyl ether-type macro monomer having a hydrophilic long chain and secondary hydroxyl groups, fluoroethylene and vinyl ethers. A further similar material is marketed under the trademark ZEFFLE™ by Daikin America, Inc.

To achieve optimum performance properties the polyhydroxyether formulation preferably includes any of the following co-resins and crosslinkers including:

1. One or more amine-functional siloxanes ideally in the form of an emulsion. The siloxane provides water repellency. Examples of such a material are NULASTIC 24E and NUSIL19E as supplied by Nulastic Incorporated. Further examples include Tegophobe (1400, 1500 and 1600 series) and Tego Proteck 5000 and 5100 series, as marketed by Degussa, and Dow Coming silicones, e. g. 2-9034, which are added for water repellency purposes.
2. Polyether based aliphatic polyurethanes containing carboxyl and/or hydroxyl groups for providing flexibility and water resistance. An example of such a material is Solucote 1023 and 1013, as supplied by Solulol Corporation. Other examples include Syncure polyurethanes from Noveon and polyurethanes from Stockhausen, Reichold, C. K. Witco, Hauthaway etc.
3. One or more cross-linkers such as a blocked isocyanate and/or an epoxidised siloxane monomer, an oxazoline, a carbo-diimide, a polyethylene imine, a polyaziridine, melamine formaldehyde resin, or an aliphatic polyisocyanate. An example of a blocked isocyanate is Grilbond IL-6 from EMS Grilon, and an example of an epoxidized siloxane monomer is Coatosil 1770 from Osi.
4. One or more wetting agent such as Coatosil 1211 from Osi, fluoro- surfactants such as Fluwet OTN from Clariant GmbH, ethylene-propylene oxide or ethylene-propylene oxide/siloxane or ethylene propylene oxide surfactants, such as Silwet from C. K. Witco or Surfynol from Air Products.

Ideally the cured, grafted layer is in the form of an Interpenetrating Polymeric Network (IPN). A mixture of cross-linkers may be selected to provide this, as well as to suit the finishing process. The cross-linkers, due to their functionality, react with themselves i.e. further polymerising at a given temperature and simultaneously cross link with the hydroxyl and carboxyl functional groups present in the other resins, such as PKHW-34F and polyurethanes, giving a much higher cross-link density and an IPN.

Before the aforementioned grafted layer is applied, it is preferable, at least in the case of polyester, to pre-activate the substrate with a priming step.

The primer consists of an activating species, a substrate specific penetrant and a wetting agent. It ideally contains a caprolactam blocked isocyanate in water. An example of a caprolactam blocked isocyanate is IL-6 from EMS Grilon. This can be used alone or in combination with a water-based epoxide, such as Grilbond G1701, as practiced in the tire reinforcement industry (c. f. TyreTech, Asia 196, Gunter Kurz). Other blocking agents can be Ketoxime or Phenol. These can be used singularly or in combination. Alternatives to primers containing blocked isocyanates are, for example, waterborne polyesters, such as AQ 29 D from Eastman Chemicals and the NS Series from Takamatsu Oil and FatCo., Ltd., and alkoxy silane primers from United Chemical Technologies Inc.

Additionally, the primer preferably includes the following additional components:

1. An alkyl phthalimide serving as a water soluble penetrant for polyesters. It acts on the polyester to open up surface pores allowing the blocked isocyanate and any dyestuff to penetrate and secure to the polyester and so activate the surface of the polyester to bond to the subsequently applied coating layer. An example of this is Cindye DAC 999 from Stockhausen.
2. One or more pre-dispersed dyes, used as a witness to penetration into the substrate yarns. An example of this is LUMACRON S3 BS Red 150% or Lumacron Navy 300% from Dohmen UK Ltd.
3. One or more wetting agents as discussed hereinbefore.
4. One or more levelling and dispersion agents.
5. One or more binding agents.
6. One or more anti-foaming agents.
7. One or more emulsifiers.
8. One or more anti-settling agents.

The primer is preferably applied by a kiss roll, dried at about 125° C., followed by a dye fixation and surface activation step at 190° C.(160–240° C.).

The second resin mixture is also preferably applied by a kiss roll followed by water removal at about 125° C. and a final grafting and curing (cross linking) step at 190° C. (160–240° C.). These are typical conditions. In theory, the treatment can be dried to any temperature over sufficient time. Curing and grafting onto the fibers will start to take place above, typically, 150° C., although the addition of catalysts, such as p-toluene sulphonic acid can be used to reduce this curing temperature and/or the time required. Application by way of foaming or spraying techniques, or like industrial processes, is feasible.

It can be seen that the primer step creates a substrate with reactive sites and the second step produces the cured, grafted IPN structure. Both steps are finished at 190° C., which is about 10–15° C. below the heat-setting temperature of a polyester fabric. The grafting and cross-linking steps renders the fabric stiff.

The low surface energy modification forms an integral part of the substrate, such as PET, and is able to withstand high pressure showers up to 600 psi or 40 bar.

In order that the present invention may be more readily understood specific embodiments thereof will now be described by way of examples.

EXAMPLE 1

A woven polyester TAD fabric is primed via a kiss roll with the primer composition set out below, typically at a concentration of 4.5% solids.

3.33 ml premixed Lumacron red dye solution (conc.330 g/l)

20 g/l Cindye DAC 999-alkyl phthalimide 40 g/l Grilbond IL-6-blocked isocyanate 5 g/l CoatoSil 1211-wetting agent Water The primer was dried at about 125° C. followed by a dye fixation and substrate activation step at 190° C.

A second resin mixture was then applied using a kiss roll. The components of the second mixture are listed below. The concentration of the second mixture was typically 4.2% solids.

54.4 g/1 Phenoxy PKHW 34F-a hydroxyl functional fluorinated polyhydroxyether;

33 g/l Solucote 1023-a carboxyl functional polyurethane 20 g/l Nulastic 24E-amine functional siloxane emulsion;

The aforementioned components together form the dispersed resin material. The two cross-linking agents, listed below, serve to create the cured and grafted IPN;

1.5 g/l CoatoSil 1211-wetting agent;

2 g/l CoatoSil 1770-cross linker-epoxidized siloxane monomer;

12 g/l Grilbond IL-6-caprolactam blocked isocyanate-crosslinker; and

Water.

The chemically modified substrate is then dried at about 125° C. prior to a final grafting and curing (cross-linking) step at approximately 190° C.

The resulting TAD fabric has a water repellency rating of 6 (a DuPont version of AATCC water repellency test; highest achievable is 6) and an oil repellency of 4 (AATCC test; highest achievable rating is 6). These are both drop test methods in which drops of liquids, of different surface tensions, are placed on the coated fabric and its spreading observed (Test Methods, Erik Kissa, page 550, quote 174).

In addition, our results showed there to be virtually no overall loss in cfm (a measure of fabric permeability, cubic feet/square foot/per minute at 12.7 mm water gauge). As an example, the air permeability of the TAD fabric was measured at 3 different stages of manufacture in cfm:

Control Sample: 705

Sanded Sample: 687

Treated Sample: 680

EXAMPLE 2

The procedure of Example 1 was repeated using the primer and resin formulation as shown below.

Again, a woven polyester TAD fabric, was primed by way of a kiss roll using a primer at a concentration of 4.5% solids.

Primer Composition 20 g/l Lumicron Blue Dye;

20 g/l Cindye DAC 999-alkyl phthalimide;

30 g/l Grilbond IL-6-binding agent;

2 g/l Coatosil 1211-wetting agent;

1.5 g/l Coatosil 1770-binding agent;

3 g/l Synthapal DEG-levelling and dispersing agent; and

Water.

This was dried at 125° C., followed by a dye fixation and substrate activation step at 190° C.

Second Resin Mixture 50 g/l PKHW34F10-a hydroxyl functional fluorinated polyhydroxyether;

60 g/l PU 10-96-1-reactive polyurethane;

7.5 g/l Coatosil 1770-cross-linker;

4 g/l Grilbond IL-6-cross-linker;

1.0 g/l Fluowet OTN-fluorinated wetting agent; and

Water.

This treatment provided a TAD fabric with a water repellancy rating of 6 and an oil repellancy of 6, both as determined using the AATCC tests as referred to in Example 1.

It is to be understood that the above described example is by way of illustration only. Many modifications and variations are possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An industrial textile, comprising:

a polymeric textile substrate and a primer layer grafting a resin system onto said polymeric textile substrate;

wherein said primer layer includes:

an activating species, a substrate specific penetrant, and a wetting agent, each component of said primer layer being chemically different;

and said resin system includes:

a water-borne thermoplastic, at least one of a polyhydroxyether resin and an analogue of polyhydroxyether resin, and at least one co-resin.

2. The industrial textile of claim 1, wherein said water-borne thermoplastic is fluorinated.

3. The industrial textile according to claim 1, wherein said polymeric textile substrate is one of a woven fabric and a non-woven fabric.

4. The industrial textile of claim 1, wherein said polymeric textile substrate is a through air drying (TAD) fabric and wherein said polyhydroxyether is fluorinated.

5. The industrial textile of claim 1, wherein said resin system includes at least one of the analogues of said polyhydroxyether resin: polyurethane modified polyhydroxyether resin, epoxy end-capped polyhydroxyether resin and polycaprolactone modified polyhydroxyether resin.

6. The industrial textile of claim 1, wherein said polymeric textile substrate includes at least one of polyester, PPS (polyphenylene sulphide), PCTA (poly 1,4cyclohexane dimethylene terephthalate), PEN (polyethylene naphthalate), PVDF (polyvinylidene fluoride) and PEEK (polyetheretherketone).

7. The industrial textile of claim 1, wherein said polyhydroxyether resin is fluorinated.

8. The industrial textile of claim 1, wherein said resin system further includes at least one of a polyurethane and a polyurethane derivative.

9. The industrial textile of claim 1, wherein said resin system includes at least one siloxane.

10. The industrial textile of claim 1, wherein said resin system is cross-linked.

11. The industrial textile of claim 1, wherein said polyhydroxyether resins are prepared as a water-borne amine-neutralized, carboxylated, polyhydroxyether resin.

12. The industrial textile of claim 1, wherein said polyhydroxyethers of said resin system have a weight average molecular weight greater than approximately 20,000 and less than approximately 45,000.

13. The industrial textile of claim 1, wherein the industrial textile has a surface having a surface energy, at least a part of said surface having said surface energy of substantially less than 20 dynes/cm.

14. The industrial textile of claim 1, wherein said resin system further includes polyether-based aliphatic polyurethanes containing at least one of carboxyl groups and hydroxyl groups.

15. The industrial textile of claim 1, wherein said resin system includes at least one cross-linker.

16. The industrial textile of claim 1, wherein said resin system further includes at least one wetting agent.

17. The industrial textile of claim 1, wherein said resin system is cured in the form of an Interpenetrating Polymeric Network (IPN).

18. The industrial textile of claim 1, wherein said primer includes a water-borne polyester.

19. The industrial textile of claim 1, wherein said primer includes at least one of the following: an alkyl phthalimide, at least one pre-dispersed dye, at least one wetting agent, at least one leveling and dispersion agents, at least one binding agent, at least one anti-foaming agent, at least one emulsifier and at least one anti-settling agent.

20. The industrial textile of claim 1, wherein said primer is applied by one of spraying, an application as a foam, by a lick-up and a kiss roll process.

21. The industrial textile of claim 1, wherein said primer is dried at about 125° C.

22. The industrial textile of claim 1, wherein said resin system is applied to said substrate by one of spraying, application as a foam, by a lick-up process and a kiss roll process.

23. The industrial textile of claim 1, wherein water is removed from said resin system at 125° C.

24. The industrial textile of claim 1, where said primer is surface activated at between 160° C. and 240° C.

25. The industrial textile of claim 24, wherein said primer is surface activated at 190° C.

26. The industrial textile of claim 1, wherein said resin mixture is grafted and cured at a temperature in a range of from approximately 160° C. to 240° C.

27. The industrial textile according to claim 18, wherein said resin mixture is grafted and cured at approximately 190° C.

28. An industrial textile comprising:

a polymeric textile substrate and a primer layer grafting a resin system onto said polymeric textile substrate, said substrate includes warp yarns and weft yarns, one of said warp yarns and said weft yarns being made from polyester and the other of said warp yarns and said weft yarns being made from PVDF (polyvinylidene fluoride) wherein said resin system includes:

a water-borne thermoplastic, at least one of a polyhydroxyether resin and an analogue of a polyhydroxyether resin, and at least one co-resin.

29. An industrial textile comprising:

a polymeric textile substrate and a primer layer grafting a resin system onto said polymeric textile substrate, said substrate being a spiral link fabric, wherein said resin system includes:

a water-borne thermoplastic, at least one of a polyhydroxyether resin and an analogue of a polyhydroxyether resin, and at least one co-resin.

30. An industrial textile comprising:

a polymeric textile substrate and a primer layer grafting a resin system onto said polymeric textile substrate, wherein said resin system includes:

a water-borne thermoplastic, at least one of a polyhydroxyether resin and an analogue of a polyhydroxyether resin, at least one co-resin, and at least one siloxane, said siloxane being an amine functional siloxane.

31. An industrial textile comprising:

a polymeric textile substrate and a primer layer grafting a resin system onto said polymeric textile substrate, wherein said resin system includes:

a water-borne thermoplastic, at least one of a polyhydroxyether resin and an analogue of a polyhydroxyether resin, at least one co-resin, and at least one ethylenically unsaturated fluorinated monomers grafted to said polyhydroxyether resin.

32. An industrial textile comprising:

a polymeric textile substrate and a primer layer grafting a resin system onto said polymeric textile substrate, wherein said resin system includes:

a water-borne thermoplastic, at least one of a polyhydroxyether resin and an analogue of a polyhydroxyether resin, at least one co-resin, and at least one cross-linker, said cross-linker including at least one of a blocked isocyanate, an epoxidised siloxane monomer, an oxazoline, a carbo-diimide, a polyethylene imine, a polyaziridine, a melamine formaldehyde resin and an aliphatic polyisocyanate.

33. An industrial textile comprising:

a polymeric textile substrate and a primer layer grafting a resin system onto said polymeric textile substrate, wherein said resin system includes:

a water-borne thermoplastic, at least one of a polyhydroxyether resin and an analogue of a polyhydroxyether resin, and at least one co-resin;

wherein said resin system further includes at least one wetting agent, said wetting agent is being one of a fluorosurfactant, an ethylene-propylene oxide, an ethylene-propylene oxide/siloxane and an ethylene propylene oxide surfactants.

34. An industrial textile comprising: a polymeric textile substrate and a primer layer grafting a resin system onto said polymeric textile substrate, said primer including a caprolactam blocked isocyanate in water and optionally a water-based epoxide, wherein said resin system includes:

a water-borne thermoplastic, at least one of a polyhydroxyether resin and an analogue of a polyhydroxyether resin, and at least one co-resin.

* * * * *